US006769191B1

(12) United States Patent
Zusman

(10) Patent No.: US 6,769,191 B1
(45) Date of Patent: Aug. 3, 2004

(54) REMOVABLE TILE SPACER

(76) Inventor: Mitchell Zusman, 14582 Sunnycrest La., Huntington Beach, CA (US) 92647

( * ) Notice: Subject to any disclaimer, the term of this patent is extended or adjusted under 35 U.S.C. 154(b) by 0 days.

(21) Appl. No.: 10/353,576

(22) Filed: Jan. 28, 2003

(51) Int. Cl.[7] ..... G01B 3/30
(52) U.S. Cl. ..... 33/526
(58) Field of Search ..... 33/526, 527, 562, 33/613, 645

(56) References Cited

U.S. PATENT DOCUMENTS

| | | | | |
|---|---|---|---|---|
| 2,642,674 A | * | 6/1953 | Schell, Jr. | 33/527 |
| 2,930,135 A | | 3/1960 | Rodtz, Sr. | |
| 3,735,497 A | * | 5/1973 | Boettcher | 33/526 |
| 4,793,068 A | | 12/1988 | Goklar | |
| 4,953,341 A | | 9/1990 | Joos | |
| 5,191,718 A | * | 3/1993 | Fox | 33/526 |
| 5,201,130 A | * | 4/1993 | Krchnak | 33/526 |
| 5,288,534 A | | 2/1994 | Tavshanjian | |
| 5,359,783 A | | 11/1994 | Smith | |
| 5,560,117 A | | 10/1996 | Tallman | |
| 6,647,685 B2 | * | 11/2003 | Annarella et al. | 33/526 |
| 2002/0121027 A1 | | 9/2002 | Kruskamp | |

* cited by examiner

*Primary Examiner*—Christopher W. Fulton
(74) *Attorney, Agent, or Firm*—Charles H. Thomas

(57) ABSTRACT

A removable tile spacer for use in properly spacing floor tiles, wall tiles, counter tiles, and other tiles having a uniform shape is provided with an integrally formed handle angled upwardly and away from the flat body of the tile spacer. The tile spacer handle projects at an angle upwardly and outwardly from a junction at the distal end of a selected one of a plurality of legs forming the tile spacer body. By locating the handle remote from the intersection of the tile spacer legs a level or straight edge can be used to properly align the tiles as they are placed on a flat, supporting surface without obstruction from the tile spacer of the invention. Also, by locating the handle for the tile spacer at the tip of one of its legs, the tile spacer is provided with an extended lever arm to facilitate removal of the tile spacer from between tiles, should removal prove difficult.

17 Claims, 3 Drawing Sheets

REMOVABLE TILE SPACER

BACKGROUND OF THE INVENTION

1. Field of the Invention

The present invention relates to an improved removable tile spacer for ensuring proper placement and spacing of ceramic tiles and other tiles requiring grout during a tile installation project.

2. Description of the Prior Art

Ceramic tiles and other types of tiles, such as slate, quarry tiles, and pavers are placed individually and require grout between individual tiles. Such tiles are supplied in uniform, incremental pieces that are fitted together with interstitial spaces therebetween to create a finished tile surface. In setting the tiles on an underlayment it is extremely important in a professional installation for the individual tiles to be uniformly spaced from each other. Failure to properly space the tiles results in a tile surface in which the individual tiles are located at irregular intervals. Not only is this aesthetically unacceptable, but irregularities in tile spacing create significant difficulties for the installer in fitting tiles against abutments, such as wall surfaces, kitchen and bathroom cabinets, counter edges, and other demarcations at which the tile installation is terminated.

The vast majority of tiles that are utilized commercially are substantially flat and have a rectangular configuration, usually square in shape. To achieve proper tile spacing small, inexpensive, disposable tile spacers are often employed. Conventional tile spacers for square and other rectangular tiles are constructed with a flat, cruciform shape or sometimes with a T-shape and are positioned at the corners of the intersections of adjacent tiles. The legs of these conventional tile spacers have a uniform width equal to the desired width of spacing between adjacent tiles. To utilize these devices the tile installer places the tile spacers at the outside corners of each tile once the tile is positioned and pressed against an adhesive coating on an underlayment surface. The next adjacent tiles to be laid are positioned against the spacers. Work proceeds until all of the tiles have been secured to the floor, wall, counter, or other surface to be tiled.

While conventional tile spacers of this type do allow a tile installer to achieve uniform spacing between adjacent tiles, at least one significant problem has persisted in their use. One very big problem with conventional spacers of this type is that they are difficult to remove prior to filling the gaps between the tiles with grout. In conventional practice a tile installer will utilize a screwdriver or some other narrow, lever type instrument to attempt to pry out the spacers from between the tiles. However, the use of such levers and other implements often results in chipping of the tiles.

Some installers simply leave the spacers in position and cover them over with grout. However, the grout does not adhere to the spacers and over time the absence of a proper bond between the grout and the spacers causes the grout to crumble and break out at the locations of the tile spacers that have been left in between the tiles.

A number of different tile spacers have been designed with handles that are shaped in the form of a post extending perpendicularly out from the intersection of the several arms of the spacer. Some different embodiments of tile spacers of this type are described, for example, in U.S. Pat. Nos. 4,793,068 and 5,359,783 and in U.S. Publication No. US 2002/0121027. The purpose of this handle is to facilitate removable of the tile spacers from between adjacent tiles. However, since the handles of tile spacers of this type project straight out from the bodies of the tile spacers at the intersections of the arms thereof, the handles present an obstruction to leveling of tiles.

That is, even when utilizing tile spacers to complete a tile surface in a professional, workmanship-like manner, a tile installer will invariably employ a straight edge or a level of some type to align the edges of adjacent tiles in a precise, rectilinear array. However, a straight edge or level cannot be utilized with conventional tile spacers having posts projecting straight out from the intersection of the tile spacer legs since such posts obstruct the proper alignment and positioning of the straight edge or level.

SUMMARY OF THE INVENTION

One primary objective the present invention is to provide a tile spacer that will not obstruct placement of a straight edge in aligning adjacent tiles during a tile installation project, but which still can be removed from between adjacent tiles quite easily. To achieve this objective the tile spacer of the invention is provided with a built-in handle that extends at an obtuse angle out from the main body of the tile. Furthermore, the junction between the handle and the legs of the tile spacer is not at the intersection of the tile spacer legs, as in conventional tile spacers. To the contrary, the handle of the tile spacer intersects only a single one of the legs at a junction that is spaced from the intersection of the tile spacer legs. As a consequence, the tile spacer handle does not present an obstruction to the use of a straight edge or level during a tile installation project.

In one broad aspect the present invention may be described as a removable tile spacer formed with a body having a plurality of legs with lower surfaces residing in a common plane and diverging from each other at right angles and a handle projecting outwardly from a single one of the legs inclined away from the body an obtuse angle relative to the common plane. That is, the handle must form an angle greater than ninety degrees and less than one hundred eighty degrees with the lower surface of the tile spacer leg from which it projects.

As a practical matter, the handle should form an angle of between about one hundred twenty degrees and about one hundred fifty degrees relative to the selected one of the legs from which it projects. In the preferred embodiments the handle forms an angle of about one hundred thirty-five degrees relative to the leg from which it extends and relative to the common plane of the lower surfaces of all of the legs forming the tile spacer body. The handle is preferably attached to the selected leg at the distal end thereof, remote from the intersection of the several legs of the tile spacer.

Preferably the legs of the tile spacer of the invention are of equal length and each leg has a thickness equal to its width. Also, it may be desirable to provide the handle with some surface irregularity to facilitate gripping the handle to pull it out from between adjacent tiles. For example, the handle of the tile spacer of the invention may be constructed with one or more raised ribs that extend transversely across the upper, inclined surface of the handle.

In another broad aspect the invention may be described as a removable tile spacer comprising a main body having a plurality of legs having undersurfaces lying in a common plane and diverging from each other from a central, common intersection at ninety degree intervals, and a handle projecting out from a junction with a selected one of the legs remote from the central common intersection and forming an obtuse angle relative to the common plane at the selected leg from which it projects.

The invention may also be described as an improvement in a flat, removable tile spacer having a plurality of legs radiating from a central, common intersection and spaced apart at ninety degree intervals. The improvement of the invention is comprised of a handle projecting outwardly and upwardly from one of the legs at a junction therewith remote from the common intersection. Preferably, the legs reside in coplanar relationship and the handle is inclined at an angle of about one hundred thirty-five degrees from the one of the legs from which it projects.

The invention may be described with greater clarity and particularity by reference to the accompanying drawings.

DESCRIPTION OF THE EMBODIMENTS

Figure 1:
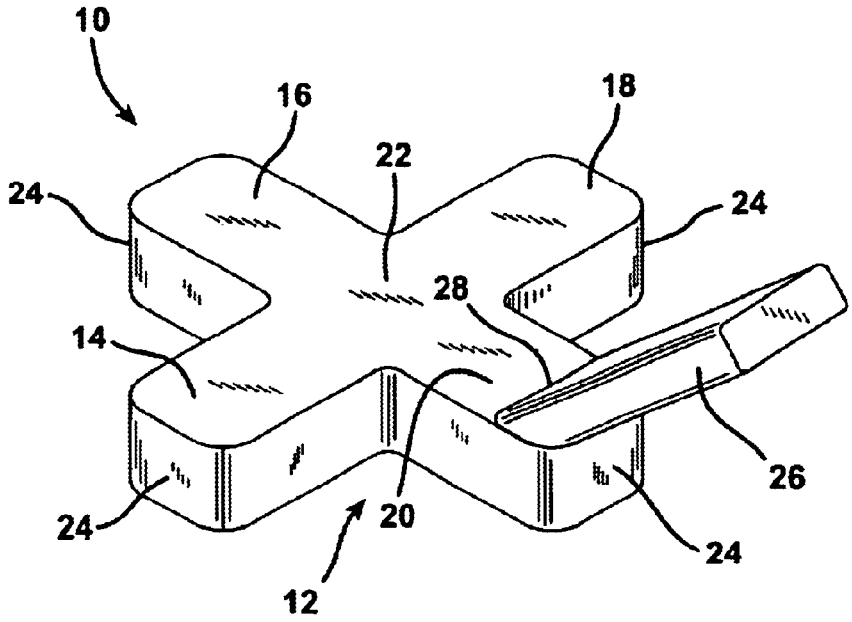
FIG. 1 is a perspective view illustrating one preferred embodiment of the tile spacer of the invention.

FIG. 1 illustrates one preferred embodiment of a removable tile spacer 10 constructed according to the invention. The tile spacer 10 is a unitary, plastic, molded structure formed with a body 12. The body 12 has four legs 14, 16, 18, and 20 oriented relative to each other in the shape of a cruciform. All four legs diverge from each other from a central, common intersection 22 and are spaced apart at ninety degree or right angle intervals as illustrated in FIG. 2.

Figure 3:
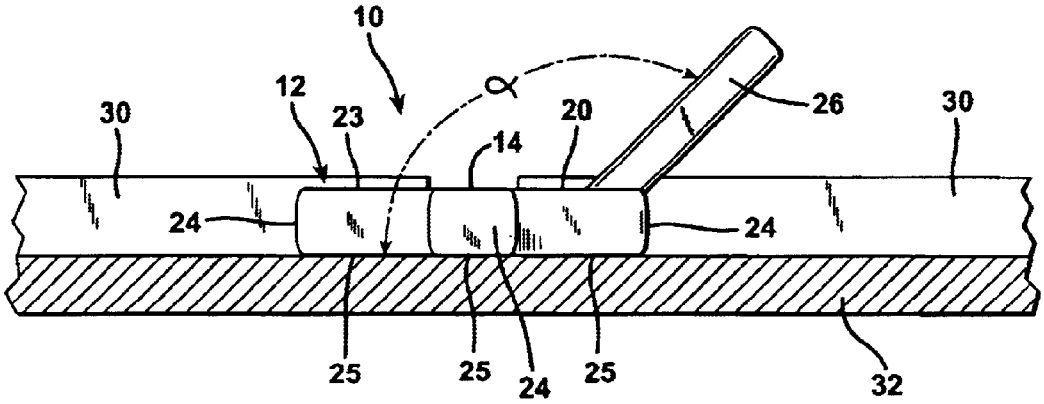
FIG. 3 is a side elevational view illustrating the use of the tile spacer of the invention depicted in FIGS. 1 and 2.

As shown in FIG. 3, each of the legs has a flat, planar, upper surface 23 and a flat, planar undersurface 25. Each of the four legs 14, 16, 18, and 20 has a proximal end located at the common intersection 22, and a remote, distal end 24. The tile spacer 10 also includes a straight, flat handle 26 that projects upwardly and outwardly from the distal end 24 of a single one of the legs, specifically the leg 20 at a junction 28 therewith, remote from the common intersection 22.

All four of the legs 14, 16, 18, and 20 of the tile spacer 10 reside in coplanar relationship, as illustrated in FIG. 3. Their undersurfaces 25 all reside in a common plane, which is the plane of the top, flat surface of the underpayment 32 upon which tiles 30 are to be installed when the tile spacer 10 is positioned between adjacent tiles 30, as shown in FIG. 3. Also as shown in that drawing figure the handle 26 is inclined at an obtuse angle $\alpha$ of about one hundred thirty-five degrees relative to the tile spacer body 12, relative to the leg 20 from which it extends, and relative to the plane of the undersurfaces 25 of all four tile spacer legs 14, 16, 18, and 20. As is evident in FIGS. 1 and 2 the distal end 24 of the leg 20 from which the handle 26 extends is located remote from and as far as possible from the common intersection 22. As seen in FIG. 3 the handle 26 projects out of the plane of the tile spacer body 12 and above the level of the upper surfaces of adjacent tiles 30 for which the tile spacer 10 provides proper, uniform spacing.

Figure 2:
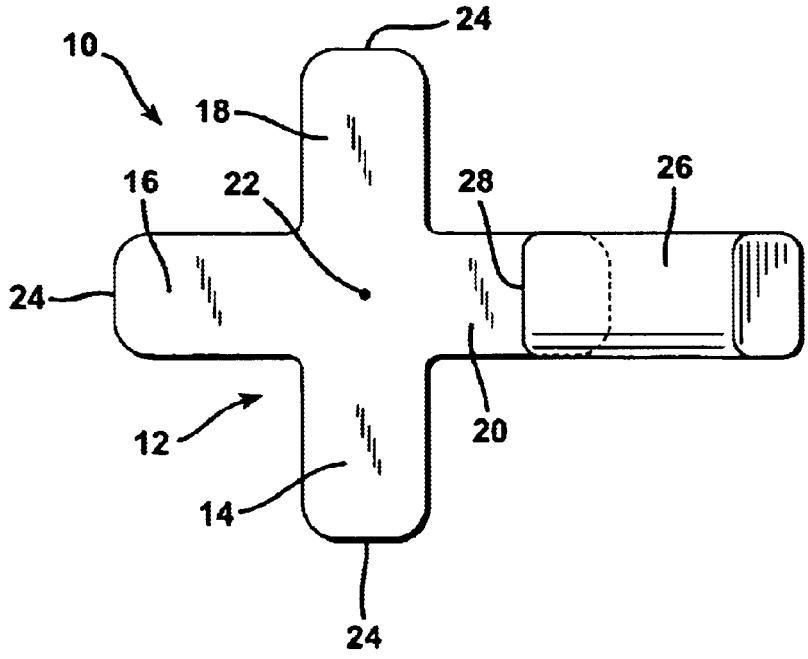
FIG. 2 is a top plan view of the tile spacer shown in FIG. 1.

As illustrated in FIG. 2, the width of the legs 14, 16, 18, and 20 is equal so that all of the tiles 30 are spaced an equal distance apart from each adjacent tiles 30. Because the handle 26 extends beyond the upper surfaces of the tiles 30, it may be grasped between the thumb and forefinger by the tile installer and removed from between adjacent tiles 30 once the adhesive bonding those tiles to the underlayment 32 has set. Preferably, the width of each tile spacer leg parallel to the plane of its undersurface 25 is equal to its thickness perpendicular to the plane of its undersurface 25 so that the tile spacer legs have a substantially square cross section.

Depending upon the size of the tiles 30, tile spacers of different sizes may be employed, although spacers of the same size are always employed throughout an entire tile project. The thickness of the body 12 of the tile spacers 10 should be less than the thickness of the tiles 30 to be set. Preferably, the thickness of the tile body 12 is about half the thickness of the tiles 30.

Tile spacers 10 according to the invention may be constructed in different sizes. The most common size utilized in the majority of tile projects has a body thickness of 3/16 of an inch and legs formed 3/16 of an inch square. The legs are typically between about one-quarter of an inch and one-half of an inch in length. Smaller sizes of tile spacers 10 may be employed in which the body thickness is 1/8 of an inch and the legs are 1/8 of an inch square. For extremely small tiles, spacers having leg dimensions of 1/16 of an inch square may be employed. Larger versions of the tile spacers 10 can be manufactured with leg cross sections one-quarter of an inch square, 3/8 of an inch square or even as large as one-half of an inch square.

Preferably, tile spacers of different sizes will be manufactured with a color code. That is, each size of tile spacer will have a designated color so that it can be easily distinguished on the job from tile spacers of other sizes.

Tile spacers 10 according to the present invention may be manufactured extremely economically. For example, during fabrication the molded tile spacers 10 can be molded with molding sprues that ultimately become the handles 26. Thus, very little material is lost during fabrication of tile spacers according to the invention.

Figure 4:
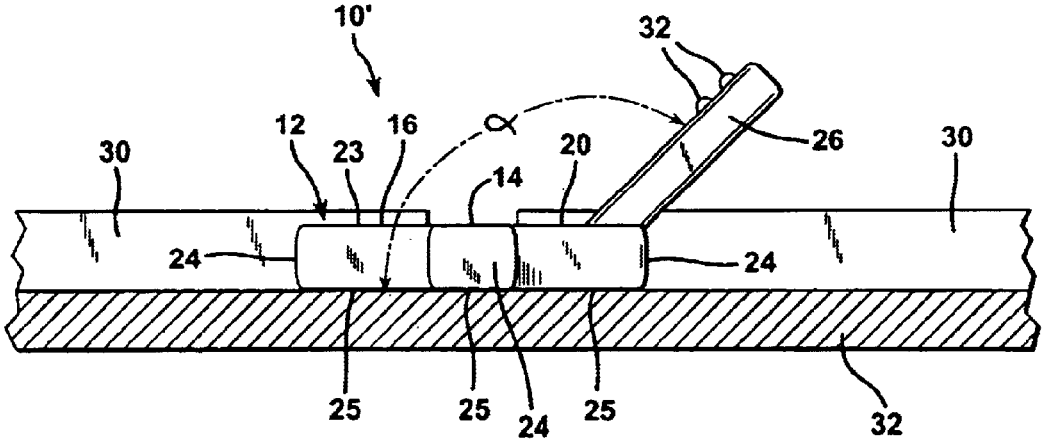
FIG. 4 is a side elevational view illustrating the use of a modified form of the tile spacer depicted in FIGS. 1 and 2.

FIG. 4 illustrates a modified tile spacer 10' having surface irregularities in the form of a pair of transverse ribs or ridges 32 that extend transversely across the width of the handle 26. The ribs 32 facilitate grasping of the handle 26 during removal of the tile spacer 10' from between the tiles 30.

Figure 5:
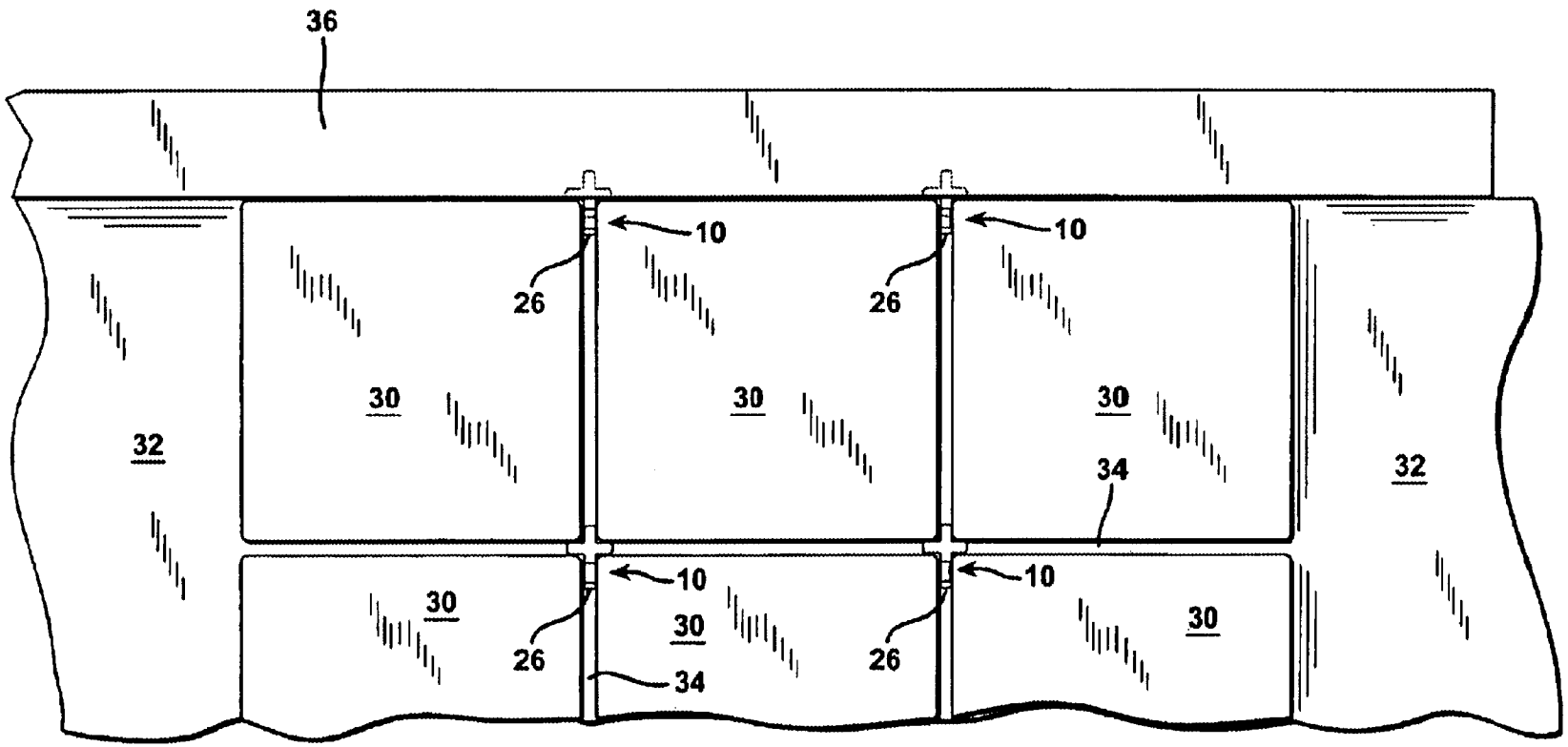
FIG. 5 is a top plan view illustrating the use of a plurality of tile spacers according to the invention in conjunction with a straight edge.

To utilize the tile spacers 10 or 10' of the invention, the tile installer places them at the corners of adjacent tiles 30, as shown in FIG. 5. The width of the tile spacer legs 14, 16, 18, and 20 determines the width of the gaps 34 between the tiles 30, which are subsequently filled with grout once the tile spacers are removed.

In laying tiles during a tiling project it is very important for the ends of the tiles 30 to be level. A straight, elongated implement, such as a straight edge or level 36 is employed for this purpose. Because the tiles 30 to be laid are thicker than the tile spacer bodies 12, the straight edge 36 can be laid atop the tile spacer legs 14, 16, and 18 to ensure that the upper edges of the tiles 30 all reside in linear alignment and abut evenly against the straight edge 36. The tile spacer leg 20 from which the handle 26 extends should be located between adjacent tiles 30 and extend in the direction away from the direction toward which the installer is laying new tiles, as illustrated in FIG. 5. In this way the handles 26 of tile spacers located in position between tiles 30 that have already been laid do not interfere with placement of the straight edge or level 36.

It is evident from the drawing figures that once the adhesive securing the tiles 30 to the underlayment 32 has set, the tile spacers 10 can be easily lifted from between the tiles 30 and removed by means of the handle 26. Furthermore, since the handle 26 of each tile spacer extends in the direction opposite the opposing leg 16 from the leg 20 to which the handle 26 is attached, an installer is provided with an extremely good lever arm for freeing the tile spacer 10 should it become attached to the underlayment 32 by adhesive. That is, and with particular reference to FIGS. 3 and 4, should the tile spacer 10 or 10' prove difficult to remove, the user can utilize the handle 26 as an extended lever arm to rotate the entire tile spacer in a counterclockwise direction, as illustrated in FIGS. 3 and 4. During removal in this manner the tile installer utilizes the lower edge of the distal end 24 of the tile spacer leg 16 as a fulcrum. The improved tile spacer 10 or 10' according to the invention thereby provides the installer with improved leverage for tile spacer removal, as contrasted with conventional tile spacers. This further aids in solving the problem of tile spacer removal from between the tiles 30.

Undoubtedly, numerous variations and modifications of the invention will become readily apparent to those familiar with tile installation devices and with accessories utilized in tile installation. Accordingly, the scope of the invention should not be construed as limited to the specific embodiments depicted and described, but rather as defined in the claims appended hereto.

I claim:

1. A removable tile spacer formed with a body having a plurality of legs wherein said body has a common, central intersection from which all of said legs diverge, and all of said legs have lower surfaces residing in a common plane and diverging from each other at right angles and a handle projecting outwardly from a single one of said legs inclined away from said body at an obtuse angle relative to said common plane, and said single one of said legs has a distal end remote from said common, central intersection, and said handle is joined to said single one of said legs at said distal end thereof.

2. A tile spacer according to claim 1 wherein said legs are of equal length and each leg has a thickness equal to its width.

3. A tile spacer according to claim 1 wherein said handle forms an angle of at least about one hundred twenty degrees relative to said common plane.

4. A tile spacer according to claim 3, wherein said handle forms an angle of about one hundred thirty-five degrees relative to said common plane.

5. A tile spacer according to claim 1 wherein said handle has an upper surface with at least one transverse rib defined thereon to facilitate gripping.

6. A tile spacer according to claim 1 wherein said handle and said single one of said legs are of equal width.

7. A removable tile spacer comprising a main body having a plurality of legs having undersurfaces lying in a common plane and diverging from each other from a central, common intersection at ninety degree intervals, and a handle projecting out from a junction with a selected one of said legs remote from said central, common intersection and forming an obtuse angle relative to said common plane with said selected leg from which it projects.

8. A removable tile spacer according to claim 7 wherein said selected one of said legs has a distal end remote from said central, common intersection and said junction from which said handle projects is at said distal end of said selected leg.

9. A removable tile spacer according to claim 7 wherein said handle is equal in width to said selected leg.

10. A removable tile spacer according to claim 7 further comprising at least one raised structure on said handle to facilitate gripping.

11. A removable tile spacer according to claim 7 further comprising a pair of raised ribs on said handle to facilitate gripping.

12. A removable tile spacer according to claim 7 wherein said handle forms an angle of between about one hundred twenty degrees and about one hundred fifty degrees relative to said selected one of said legs.

13. A removable tile spacer according to claim 7 wherein said handle forms an angle of about one hundred thirty-five degrees relative to said selected one of said legs.

14. In a flat, removable tile spacer having a plurality of legs radiating from a central, common intersection and spaced apart at ninety degree intervals, the improvement comprising a handle projecting upwardly and outwardly from one of said legs at a junction therewith remote from said common intersection.

15. A tile spacer according to claim 14 wherein said legs reside in coplanar relationship and said handle is inclined at an angle of about one hundred thirty-five degrees from said one of said legs.

16. A tile spacer according to claim 15 wherein said one of said legs has a distal end remote from said common intersection and said junction between said one of said legs and said handle lies at said distal end of said one of said legs.

17. A tile spacer according to claim 14 wherein said handle has an irregular surface to facilitate gripping.

* * * * *